United States Patent [19]

Borows

[11] 4,429,798

[45] Feb. 7, 1984

[54] PROTECTED GLASS JAR WITH CLOSURE

[76] Inventor: Allan A. Borows, 1889 Palmer Ave., Larchmont, N.Y. 10538

[21] Appl. No.: 387,406

[22] Filed: Jun. 11, 1982

[51] Int. Cl.[3] ..... B65D 8/06; B65D 23/00

[52] U.S. Cl. ..... 215/12 R

[58] Field of Search ..... 215/10, 12 R, 13 R

[56] References Cited

U.S. PATENT DOCUMENTS

| | | | |
|---|---|---|---|
| 2,575,283 | 11/1951 | Menrath | 215/12 R |
| 2,859,085 | 11/1958 | Morrison | 215/12 R |
| 2,991,896 | 7/1961 | Glover et al. | 215/12 R |
| 3,096,897 | 7/1963 | Hansen | 215/13 R |
| 3,156,279 | 11/1964 | Grebowiec et al. | 215/13 R X |
| 3,311,248 | 3/1967 | Marchant | 215/13 R |
| 4,240,560 | 12/1980 | Carluccio | 215/12 R |

FOREIGN PATENT DOCUMENTS

| | | | |
|---|---|---|---|
| 916169 | 1/1963 | United Kingdom | 215/12 R |
| 1211769 | 11/1970 | United Kingdom | 215/12 R |

*Primary Examiner*—William Price
*Assistant Examiner*—Sue A. Weaver
*Attorney, Agent, or Firm*—H. Gibner Lehmann; K. Gibner Lehmann

[57] ABSTRACT

A protected glass container for cosmetic and like substances, has an inner glass jar and an outer plastic protective jacket, both said parts having coengaging top rim portions arranged to position and secure the parts together. The rim portion of the glass jar engages the sealing liner of a closure cap, which has screw threads engageable with cooperable threads on the rim portion of the plastic jacket. The jar and jacket have spaced-apart side and bottom walls, and the rim portion of the jar is subjected mainly to compressive forces which are non-destructive. Tightening of the closure cap tends to increase the interlock between the rim portions of the jar and jacket.

7 Claims, 4 Drawing Figures

PROTECTED GLASS JAR WITH CLOSURE

BACKGROUND

This invention relates to small containers such as jars and the like, as used for the holding and dispensing of cosmetics, foods, etc., and more particularly to containers constituted mainly of glass, desired for its property of being inert chemically.

The use of wide-mouth jars for holding and dispensing foods, cosmetics, pharmaceuticals, household products and numerous varieties of pastes, ointments, creams, salves and quasi-viscous products is well established. In the past, containers which served this purpose used to be constituted exclusively of flint glass, opal glass, ceramic material and colored soda lime glass. More recently, jar constructions have comprised resinous materials, such as polyethylene, polypropylene, polystyrene, acrylonitriles and polyesters. However, the use of these plastic materials resulted in a limited efficacy in the containing of many products that are sensitive to oxygen and moisture, since no plastic material could offer the barrier to gases and vapors that glass could. Furthermore, highly acidic formulations and those containing hydrocarbon solvents would attack, swell, soften and dissolve many of the plastic resins.

Glass containers have long been recognized for their superior barrier properties and maintenance of product purity and cleanliness. However, they have the drawback of being susceptible to fracture, often into sharp shards, as a consequence of impact, thermal shock, pressures, torsion and internal strains. Glass containers generally follow the physical laws which apply to glass members as a class. A principal rule teaches that glass fails when it is placed in tension, as by outside forces, internal forces, etc., whereas glass stoutly resists failure due to compression forces exerted on it.

In connection with containers, mouth or neck finishes refer to the configurations at the openings, involving the screw threads, lugs, sealing surfaces and sizes. In the case of glass, continuous-thread type finishes, lug-type finishes and special configurations in which a closure turns or clamps onto the neck represent almost exclusively the zones of axial tension or loading. These are the areas which are particularly sensitive to glass manufacturing defects, since they are the first to be formed, and are used in the transfer of the container during the intermediate molding stages and prior to the annealing of the glass.

SUMMARY

The above disadvantages and drawbacks of prior containers of the kind indicated are obviated by the present invention, and one object of the invention is to provide a novel and improved container for the purposes indicated, which has the listed advantages of glass while eliminating the disadvantages attendant thereto.

Another object of the invention is to provide an improved container as above set forth, which has excellent barrier properties, resistance to product attack, and maintenance of purity while being rugged and durable throughout extended periods of use.

A further object of the invention is to provide an improved container having a glass component, wherein the glass material is relieved of tensile stresses and subjected instead to mostly compressive forces.

Still another object of the invention is to provide an improved container as above characterized, wherein the fastening threads are constituted of plastic yet the product seal to the closure cap is made against glass sealing surfaces.

Yet another object of the invention is to provide an improved container in accordance with the foregoing, wherein the product-containing glass component is enclosed in a protective plastic jacket, thereby to insure the glass surfaces from impact damage.

A still further object of the invention is to provide an improved container as outlined above, wherein spacing is provided between the respective walls of the glass component and the protective plastic jacket in a way to minimize the likelihood of thermal shock.

Yet another object of the invention is to provide an improved container of the kind indicated, wherein the protective jacket can wholly confine glass fragments in the event of severe stress that is sufficient to shatter the glass component.

Features of the invention include the provision of a container with a glass product-storage component, wherein decoration is greatly facilitated and reduced in cost through the use of resinous printing inks as contrasted with silk-screen applied ceramic paints that require firing or fusing to the supporting surfaces; and the provision of a rim-interlock configuration in conjunction with rounded or camming-type fastening threads by which the act of tightening of the closure cap tends to secure the rim portions of the container components more tightly to each other.

Still other features and advantages will hereinafter appear.

In accomplishing the above objects the invention provides an inner, inert jar part which is constituted of glass and has an annular side wall and a transverse bottom wall joined thereto. The inert jar part has an annular top sealing rim portion and positioning means in the form of a bead and groove on the outer annular surface of its rim portion. A protective jacket is provided for the jar part, constituted of shock-resistant plastic, said jacket having an annular side wall and a transverse bottom wall that is joined to the side wall. The jacket has a top rim portion on its side wall, and has a positioning surface on said rim portion that is cooperable with the positioning means of the jar part. The top rim portion of the jacket has fastening means in the form of screw threads on its outer annular surface, for engagement by a closure cap of usual type, having a sealing liner. The closure cap has fastening means in the form of screw threads, for engagement with the threads of the plastic jacket, and the sealing liner engages the top sealing rim portion of the jar, which projects above the rim portion of the plastic jacket. The positioning elements of the jar and jacket are in the form of beads and cooperable grooves receiving the beads, whereby an interlocking connection is effected. The inner jar part, being glass, does not readily yield under pressures, and the rim portion of the plastic jacket can be stressed inwardly against the jar part by the camming action of the rounded screw threads of the closure cap and jacket. Thus, by the action of tightening the closure cap, the inward stressing of the rim portion of the jacket locks it more securely against the rim portion of the glass jar.

An embodiment of the invention is illustrated in the accompanying drawings, wherein.

Figure 2:
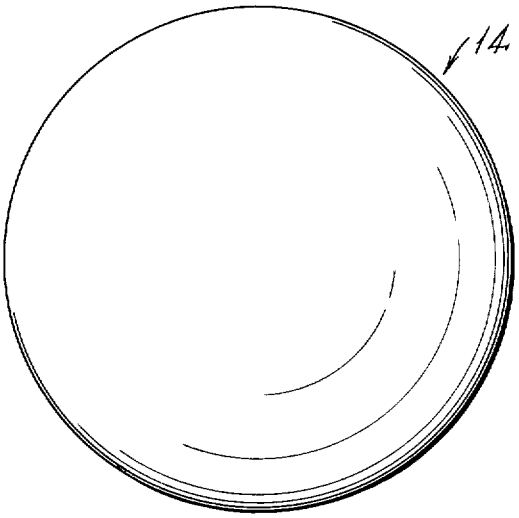
FIG. 2 is a top plan view of the closure cap for the container.

As shown, the container of the invention comprises essentially an inner, inert glass jar part 10 and an outer, protective plastic jacket 12. Cooperable with the parts 10 and 12 is a screw cover or closure cap 14. The jar part 10 has an annular top sealing rim portion 16, and a shoulder or positioning means on the outer, annular surface of the rim portion, said positioning means comprising an annular groove 18 and below the groove 18 an annular bead 20. The rim portion 16 can be of somewhat thicker wall section than the remainder of the jar part, as shown at 22 in FIG. 3, for purposes of strength.

The protective jacket 12 for the inert jar part 10 is constituted of shock-resistant plastic of resilient characteristic, such as polyolefin, vinyl, polyester, impact-modified polystyrene or acetal. The jacket 12 has a top rim portion **22*a* provided with a positioning surface on its inside, comprising shoulder means in the form of an annular bead 24 and an annular groove 26 disposed below the bead 24. The bead 24 and groove 26 cooperate respectively with shoulder means on the outer side of the jar part, comprising the groove 18 and bead 20 of the jar part; that is, the bead 24 is received in the groove 18, and the bead 20 is received in the groove 26. In effecting this assembly, the plastic material of the outer jacket part 12 stretches somewhat, and then becomes restored to its original shape whereby it closely and snugly fits around the rim portion 16** of the jar part.

The inert jar part 10 has annular side walls 28 and a transverse bottom wall 30 joined to the side walls 28. The bottom wall 30 is concavo-convex, having its convex side uppermost as shown, whereby the underside of the bottom wall can be thought of as hollow.

Figure 3:
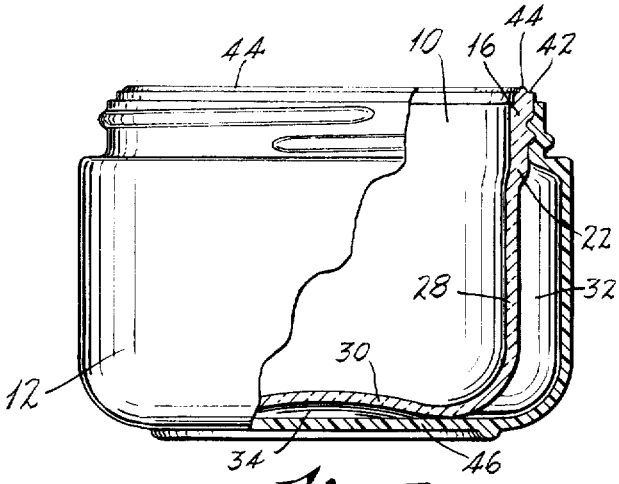
FIG. 3 is a view partly in side elevation and partly in axial section, of the assembled container.

When the jar part is assembled to the jacket, as seen in FIG. 3, there exists an annular space 32 between the annular walls of the parts, and also a space 34 between the bottom walls thereof. This is of advantage in minimizing the likelihood of thermal shock to the glass jar 10, and also impact blows which might tend to shatter the glass jar.

Figure 1:
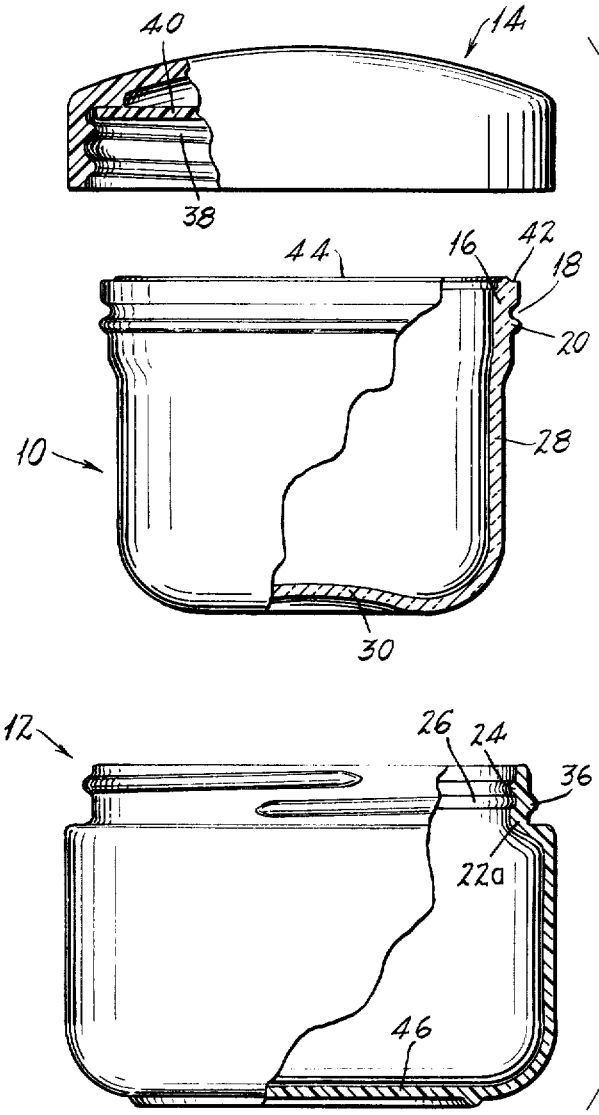
FIG. 1 is a exploded view of the container as provided by the invention, with the inner glass jar part shown removed from the outer protective plastic jacket, as prior to the final assembly of these parts.
Figure 4:
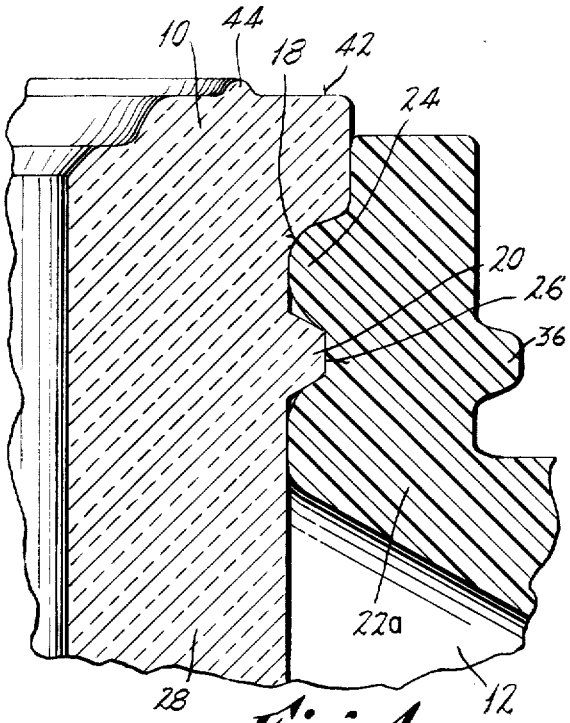
FIG. 4 is an enlargement, in section, of the rim portions of the glass jar and outer protective plastic jacket.

The top rim portion **22*a* of the jacket 12 has sloped fastening means in the form of screw threads 36 on its outer annular surface, for engagement by a closure. For cooperation with the screw threads 36, the closure cap 14 has sloped fastening means comprising internal screw threads 38. The screw threads 36 and 38 are said to be sloped because they have rounded configurations in cross section, as seen in FIGS. 1 and 4, and this has the effect of applying inward camming forces on the annular rim portion 22*a* of the jacket 12. Thus, when the cap 14 is screwed down tightly, the annular rim portion 22*a* of the jacket will be forced tightly against the annular rim portion 16 of the glass jar, due to the resilient nature of the plastic substance of the jacket. But the glass jar is constituted of substantially incompressible material, whereby it does not yield under such pressure. Therefore, a very secure interlock is effected between the beads and grooves of the rim portions, making for a secure attachment while the cap 14** is in place.

As seen in FIG. 3, the top rim portion 16 of the jar 10 extends appreciably above the top rim portion **22*a* of the jacket. The closure cap 14 is provided with a sealing liner 40 which is adapted to engage and seal against the top surface 42 of the jar rim. Also, such top surface has an annular bead 44 which digs into the liner 40** and provides a more effective seal therewith.

It will be understood that the glass jar 10 can be readily manufactured by the press-blow or blow-blow methods commonly used in the glass industry. The jacket 12 can be injection molded, injection blow-molded, extrusion blow-molded, or rotation molded. With the construction shown, the rim portion 16 of the glass jar 10 is subjected mostly to compressive stresses, and is relieved of tensional forces whereby it becomes a very durable component of the assembly. Due to the protective influence of the jacket 12, the glass is not likely to become broken; should it suffer severe impact forces and shatter, the fragments will be contained by the plastic jacket. The jar 10, moreover, will provide an effective barrier for the product contained therein, whereby the container can be seen to constitute a distinct advance and improvement in the art. Fabrication is quickly and easily effected, and the cost to produce is low.

Various sizes of inner glass jar components can be utilized with a given size of outer protective jacket. As seen in FIG. 3 the bottom wall 30 of the jar 10 is resting on the bottom wall 46 of the plastic jacket. However, the jar wall 30 can be spaced above the jacket wall 46, without detracting seriously from the advantages of the container construction.

The advantages of a glass container are had while the decoration drawbacks are eliminated, since resinous printing inks can be used on the plastic jacket 12, requiring only low drying and curing temperatures and short time intervals. There is thus less cost, and less energy involved in the decorating. The silk-screen decorating used on glass surfaces utilizes ceramic paints, which are fused to the glass at high temperatures, just below the melting point of the glass. Such decoration is more costly, requiring a greater time and larger amounts of energy. The decorative advantages are in addition to the benefits listed above.

Other variations and modifications of the invention are possible without departing from the spirit of the claims.

I claim:

1. A double-walled container for cosmetic and like substances, comprising in combination:

(a) a jar part constituted of substantially non-compressible material, having an annular side wall and a transverse bottom wall joined thereto, (b) said jar part having an annular top sealing rim portion and shoulder means on the outer annular side surface of said rim portion, (c) an outer jacket for and assembled to said jar part, constituted of yieldable material, said jacket having an annular side wall and a transverse bottom wall joined to said side wall, (d) said jacket having a top rim portion on said side wall, and having shoulder means on its inner side surface engageable and cooperable with the said shoulder means of the jar part, (e) said top rim portion of the jacket being fully exposed upwardly of the jacket and being uncovered when the jar part and jacket are assembled to each other, and said top rim portion of the jacket having sloped fastening means on its outer annular side surface for engagement by a closure cap, (f) a turnable closure cap having a sealing liner, (g) said sealing liner engaging the said annular top sealing rim portion of the jar part to seal closed the contents of the latter, and (h) said closure cap having sloped fastening means on its inner side surface, cooperable with the said sloped fastening means of said jacket to pull the closure cap closed when it is turned, and cooperable by a camming action with the sloped fastening means of said jacket to exert radially-inward pressures on the top rim portion of the latter, thereby to securely lock the rim portions of the non-compressible jar part and the yieldable jacket to each other in response to tightening of the closure cap by virtue of interaction of the said fastening means with each other in yielding and non-yielding relation respectively, whereby separation of the jacket from the jar part is minimized when the closure cap is closed.

2. The invention as defined in claim 1, wherein:

(a) the annular top sealing rim portion of the jar part extends above the top rim portion of the jacket.

3. The invention as defined in claim 1, wherein:

(a) the shoulder means of the jar part and the annular side wall of the jacket have an interlocking relationship with each other.

4. The invention as defined in claim 1, wherein:

(a) the fastening means of the jacket and closure cap comprise screw threads.

5. The invention as defined in claim 3, wherein:

(a) the shoulder means of the jar part and the annular side wall of the jacket comprise annular shoulders.

6. The invention as defined in claim 1, wherein:

(a) the jar part comprises glass, and the jacket comprises a plastic substance.

7. The invention as defined in claim 1, wherein:

(a) the sloped fastening means of the jacket and closure cap comprise screw threads of rounded configuration.

* * * * *